US005287084A

United States Patent [19]

Sone

[11] Patent Number: 5,287,084

[45] Date of Patent: Feb. 15, 1994

[54] THIN BUZZER

[75] Inventor: Takahiro Sone, Shizuoka, Japan

[73] Assignee: Star Micronics Co., Ltd., Shizuoka, Japan

[21] Appl. No.: 824,352

[22] Filed: Jan. 23, 1992

[30] Foreign Application Priority Data

Feb. 1, 1991 [JP] Japan ..... 3-003295[U]

[51] Int. Cl.[5] ..... G08B 3/00

[52] U.S. Cl. ..... 340/388.4; 340/391.1

[58] Field of Search ..... 340/388, 393, 384 R

[56] References Cited

U.S. PATENT DOCUMENTS

| | | | |
|---|---|---|---|
| 3,945,004 | 3/1976 | Myers | 340/388 |
| 4,075,626 | 2/1978 | Sakaguchi et al. | 340/388 |
| 4,149,153 | 4/1979 | Shigemori et al. | 340/388 |
| 4,175,262 | 11/1979 | Harakawa | 340/388 |
| 4,286,257 | 8/1981 | Slavin et al. | 340/388 |
| 4,413,253 | 11/1983 | Hofer et al. | 340/388 |
| 4,823,110 | 4/1989 | Dorward et al. | 340/388 |

FOREIGN PATENT DOCUMENTS

| | | |
|---|---|---|
| 0289264 | 2/1988 | European Pat. Off. . |
| 3134319 | 6/1982 | Fed. Rep. of Germany . |
| 2-34900 | 2/0590 | Japan . |
| 109576 | 8/1975 | Japan . |
| 54-178522 | 12/1979 | Japan . |
| 57-105700 | 6/1982 | Japan . |
| 57-153398 | 9/1982 | Japan . |
| 116492 | 6/1986 | Japan . |
| 63-33197 | 3/1988 | Japan . |
| 2074773 | 11/1981 | United Kingdom . |

*Primary Examiner*—Donnie L. Crosland
*Attorney, Agent, or Firm*—Koda and Androlia

[57] ABSTRACT

A small and thin buzzer which can be mounted on a printed circuit board. A buzzer assembly and a lead connecting chamber are provided in a buzzer case. One end of each of the terminals for external connection is extended to the inside of the lead connecting chamber and the exciting coil terminals of the buzzer assembly are connected to the terminals for external connection within the buzzer case. A lead groove for leading the exciting coil terminals therethrough are provided on the inner surface of the buzzer case. Thus, the connection between the exciting coil terminals and the terminals for external connection is facilitated and a resonance space for the buzzer assembly is secured.

6 Claims, 5 Drawing Sheets

THIN BUZZER

BACKGROUND OF THE INVENTION

1. Field of the Invention

The present invention relates to a thin buzzer and, more particularly, to the improvement in a small and thin buzzer which is directly mounted on a printed circuit board.

2. Description of the Related Art

Various electronic parts are standardized as chip parts in order to enable automatic assembly. A thin buzzer which is directly mounted on a printed circuit board so as to be used as a call buzzer for a pocket receiver such as a pager has also been developed as a buzzer which can be mounted on a printed circuit board by applying a cream solder or the like to the buzzer in the same way as in mounting such chip parts.

Japanese Patent Laid-Open No. Hei 2-34900 (Japanese Patent Application No. Sho 63-185061) discloses an example of such a buzzer equipped with terminals for mounting the buzzer on a printed circuit board. These terminals provided on the base of the buzzer enable the buzzer to be automatically mounted on a printed circuit board.

Such a buzzer can be mounted on the desired printed circuit board on a series of automatic assembly lines in the same way as other electronic chip parts, and the application range for a buzzer is greatly enlarged.

A conventional buzzer, however, cannot be made thin and since the thickness of the buzzer is larger than the other electronic chip parts, the size of an apparatus incorporating such a printed circuit board cannot be made small. Japanese Utility Model Laid-Open No. Sho 63-33197 discloses a small-sized and light-weight buzzer which is used for a wireless receiver. In this conventional apparatus, however, the structure for connecting the terminals for external connection and the exciting coil terminals is apt to increase the thickness of the buzzer, so that it is impossible to produce a thin buzzer which fits the demands.

To state this more specifically, in the conventional treatment of exciting coil terminals, the coil terminals guided through an opening portion are soldered to the terminals for external connection and the opening portion is thereafter sealed by a sealing adhesive. In this case, the solder or the sealing adhesive sometimes protrudes out of the buzzer case depending upon the unevenness of the amount of solder or sealing adhesive. As a result, in mounting the buzzer on the circuit board, the buzzer as a whole protrudes from the circuit board so that positioning of the buzzer on the circuit board by a mounting machine is made difficult.

As conventional general buzzers, for example, those having the structures shown in Japanese Utility Model Laid-Open Nos. Sho 54-178522, Sho 57-105700 and Sho 57-153398 are known. In this conventional buzzers, the exciting coil terminals are treated in the buzzer assembly. Since the terminals for external connection are close to the coil terminals, the workability is very bad when treating the coil terminals. Furthermore, since these buzzers have a general buzzer structure, they cannot be mounted on a printed circuit board unlike a buzzer in accordance with the present invention.

SUMMARY OF THE INVENTION

Accordingly, it is an object of the present invention to eliminate the above-described problems in the related art and to provide a small and thin buzzer which facilitates the connection between the exciting coil terminals and the terminals for external connection, thereby enabling the mass production thereof, and which has a structure for maintaining the dimensional accuracy of the external shape, thereby enhancing the reliability of the operation of positioning and fixing the buzzer to a circuit board.

To achieve this aim, the present invention provides a thin buzzer comprising: a buzzer case which incorporates a buzzer assembly including an exciting coil and a lead connecting chamber provided adjacently to the buzzer assembly; and terminals for external connection each of which is integrally connected to the buzzer case with one end externally exposed and the other end extended to the lead connecting chamber; the terminals of the exciting coil being connected to the terminals for external connection in the lead connecting chamber of the buzzer case.

According to the present invention, the buzzer case is provided with the buzzer assembly and the lead connecting chamber adjacent to the buzzer assembly, and the exciting coil terminals are led out of the buzzer assembly to the lead connecting chamber in the buzzer case. Since the lead connecting chamber has a wide space, electrical connection between the exciting coil terminals and the terminals for external connection is facilitated. The buzzer of the present invention is therefore advantageous in that the solder for maintaining the electrical connection between the exciting coil terminals and the terminals for external connection and the sealing adhesive for sealing the opening for leading out the coil therethrough are accommodated in the lead connecting chamber without protruding from the buzzer.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
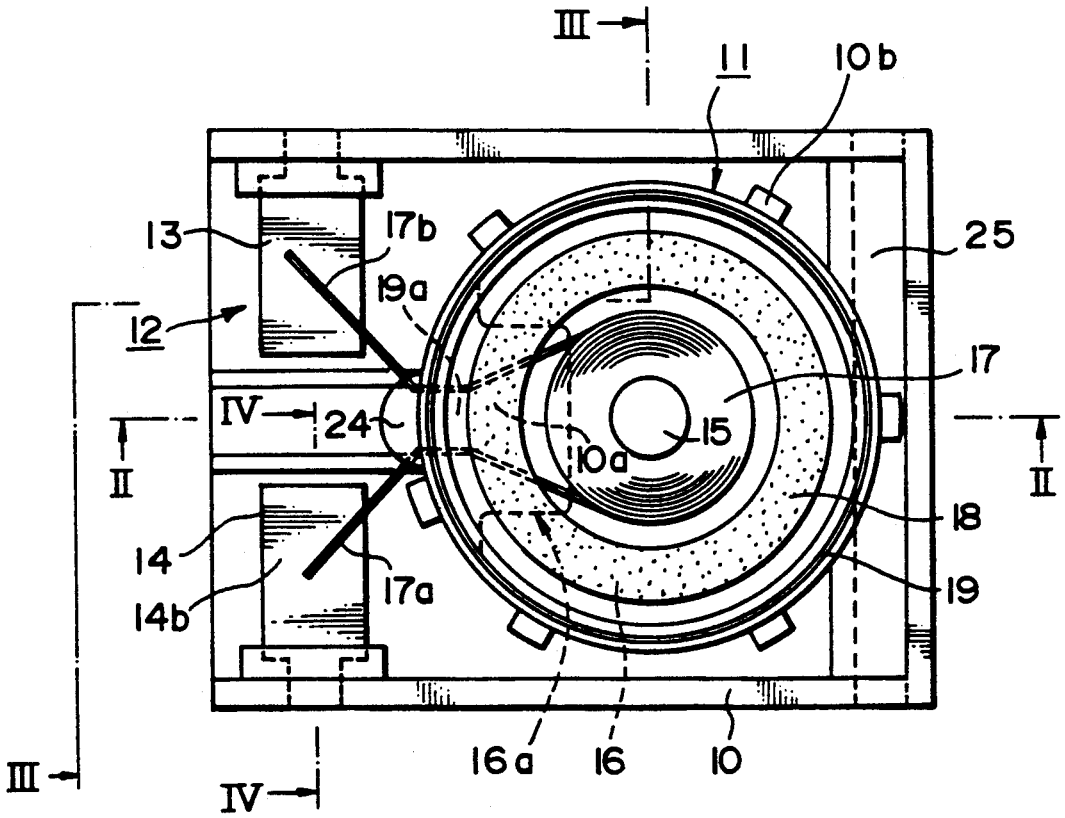
FIG. 1 is a plan view of a first embodiment of a thin buzzer according to the present invention with the lid and the diaphragm removed therefrom.
Figure 2:
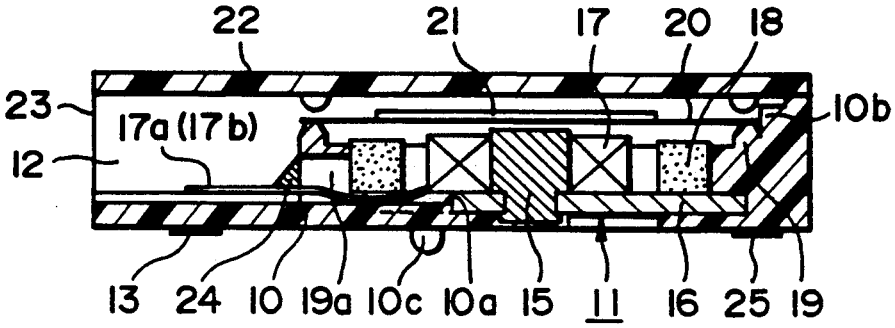
FIG. 2 is a sectional view of the first embodiment shown in FIG. 1 with the lid and diaphragm attached thereto, taken along the line II—II.
Figure 3:
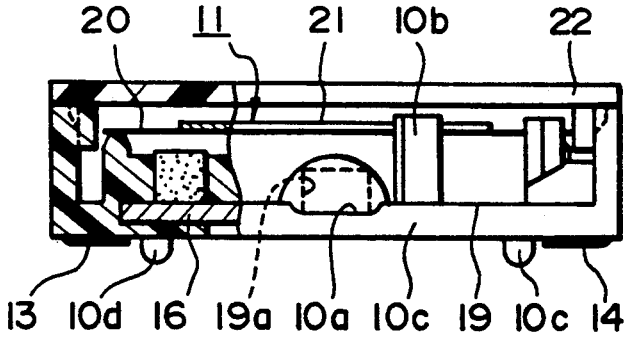
FIG. 3 is a sectional view of the first embodiment shown in FIG. 1 with the lid and diaphragm attached thereto, taken along the line III—III.
Figure 4:
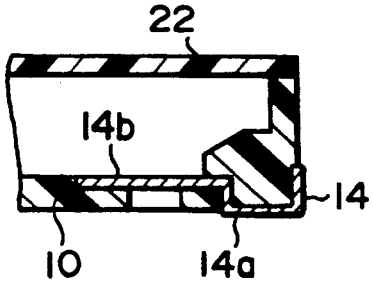
FIG. 4 is a sectional view of the first embodiment shown in FIG. 1, with the lid attached thereto, taken along the line IV—IV.

Preferred embodiments of a thin buzzer according to the present invention will be explained with reference to the accompanying drawings.

FIGS. 1 to 4 show a first embodiment of a thin buzzer according to the present invention.

In these drawings, a buzzer case 10 is produced by plastic injection molding, and a buzzer assembly 11 is incorporated thereinto. A lead connecting chamber 12 is provided adjacent to the buzzer assembly 11. In the present invention, since a space for connecting the exciting coil terminals to the terminals for external connection is secured in the lead connecting chamber, the workability is improved and the solder or the like is prevented from protruding to the outside of the buzzer case 10. In addition, in this embodiment, the lead connecting chamber 12 is also effective for forming an effective resonance space at the time of being activated.

Terminals 13, 14 for external connection are fixed to the lead connecting chamber 12. As is obvious from FIG. 4, one end 14*a* of the terminal 14 is exposed to the outside of the buzzer case 10 so as to mount the buzzer on a printed circuit board, and the other end 14*b* is extended to the lead connecting chamber 12 of the buzzer case 10 so that the exciting coil terminals of the buzzer assembly 11 are connected to the terminals 13, 14 within the buzzer case 10.

In this embodiment, the terminals 13, 14 for external connection are molded integrally with the buzzer case 10 by insert molding.

The buzzer assembly 11 in this embodiment will now be explained.

The buzzer assembly 11 includes an iron core 15 and a yoke base 16 which is fixed to the iron core 15 by riveting. Both of the iron core 15 and the yoke base 16 are composed of a high-permeability material and they are molded integrally with the buzzer case 10 by insert molding in the same way as the terminals 13, 14 for external connection. The yoke base 16 therefore constitutes a part of the buzzer case 10.

An exciting coil 17 is fixed to the periphery of the iron core 15 by an adhesive, and the terminals 17*a*, 17*b* of the exciting coil 17 are connected to the terminals 13, 14 for external connection.

A magnet 18 is disposed around the exciting coil 17. Although the magnet 18 is an annular magnet in this embodiment, it may be a magnet assembly composed of a plurality of segment or rectangular magnets. A diaphragm supporting frame 19 is disposed around the magnet 18. In this embodiment, since the diaphragm supporting frame 19 is integrally molded with the buzzer case 10, the magnet 18 is supported along the inner wall of the diaphragm supporting frame 19 in the fixed state. The magnet 18 not only attracts a diaphragm 20 placed on the diaphragm supporting plate 19 so as to firmly position the diaphragm 20 on the diaphragm supporting frame 19 but also applies a bias magnetic force to an iron piece 21 which is fixed on the diaphragm 20. In this embodiment, the magnet or magnet assembly 18 and the diaphragm supporting frame 19 have an annular shape, and the diaphragm 20 itself also has an annular shape.

The iron piece 21 not only constitutes a magnetic circuit of the buzzer but also determines the buzzer resonance frequency. The diaphragm 20 need not always be made of a high-permeability material when the iron piece 9 is used.

In the buzzer case 11, a plurality of (six, in this embodiment) buzzer ribs 10*b* are provided on the periphery of the diaphragm supporting frame 19, and the diaphragm 20 placed on the supporting frame 19 is firmly positioned by the plurality of ribs 10*b*.

In this way, the buzzer assembly 11 is incorporated into the buzzer case 10, and a lid 22 is firmly fixed to the buzzer case 10 by ultrasonic adhesion or the like. In the buzzer, a part of the box body composed of the buzzer case 10 and the lid 22 constitutes an opening 23, which constitutes a sounding opening.

In the buzzer assembly 11 of this embodiment, the buzzer case 10, the diaphragm supporting frame 19 and the diaphragm 20 constitute a first resonance space for the sounding portion, and it is possible to secure the necessary volume by a slight exciting current. In addition, in this embodiment, the lead connecting chamber 12 constitutes a second resonance space, which is useful for producing an improved acoustic efficiency.

The most characteristic feature of the apparatus provided with the buzzer case 10 including the buzzer assembly 11 and the lead connecting chamber according to the present invention lies in the structure for safely and easily introducing the terminals of the exciting coils 17 to the terminals 13, 14 for external connection. For this purpose, a lead groove 10*a* for guiding the exciting coil terminals 17*a*, 17*b* are provided on the inner surface of the buzzer case 10. In this embodiment, since the yoke base 16 also constitutes a part of the buzzer case 10, a substantially rectangular notch 16*a* for passing the exciting coil terminals 17*a*, 17*b* therethrough is formed, as shown in FIG. 1.

In this embodiment, since the diaphragm supporting frame 19 is integrally formed with the buzzer case 10, a through hole 19*a* is provided in the supporting frame 19 at the portion corresponding to the lead groove 10*a*.

Therefore, the exciting coil terminals 17*a*, 17*b* are led into the lead connecting chamber 12 through the notch 16*a* of the yoke base 16, the lead groove 10 provided on the inner surface of the buzzer case 10 and the through hole 19*a* of the supporting frame 19, and thereafter the exciting coil 17 is secured to the iron core 15 by an adhesive. In this state, the magnet 18 is secured to the inner wall of the supporting frame 19.

The exciting coil terminals 17*a*, 17*b* which are led into the lead connecting chamber 12 are connected to the terminals 13, 14, respectively, for external connection by a cream solder or the like.

The lead groove 10 is sealed by an adhesive 24. In this embodiment, the through hole 19*a* of the supporting frame 19 is sealed simultaneously with the sealing of the lead groove 10 and, as a result, the resonance space for the buzzer assembly assumes an adequately closed state.

In this way, according to the first embodiment, the exciting coil terminals 17*a*, 17*b* of the buzzer assembly 11 are led into the lead connecting chamber 12 through the notch 16*a*, the lead groove 10*a* and the through hole 19*a*, thereby facilitating the connection of the exciting coil terminals 17*a*, 17*b*.

It is very easy to automatically mount the thus produced small and thin buzzer on a printed circuit board (not shown) by attaching the terminals 13, 14 for external connection which are exposed to the circuit, by a cream solder or the like.

In this embodiment, pins 10*c*, 10*d* provided on the under surface of the buzzer case 10 are used to position the buzzer case 10 on the printed circuit board. The reference numeral 25 denotes a dummy terminal which is provided on the buzzer case 10 by insert molding in the same way as the terminals 13, 14 for external connection, and which serves as a reinforcing terminal when mounting the buzzer on the printed circuit board by the terminals 13, 14 for external connection.

Figure 5:
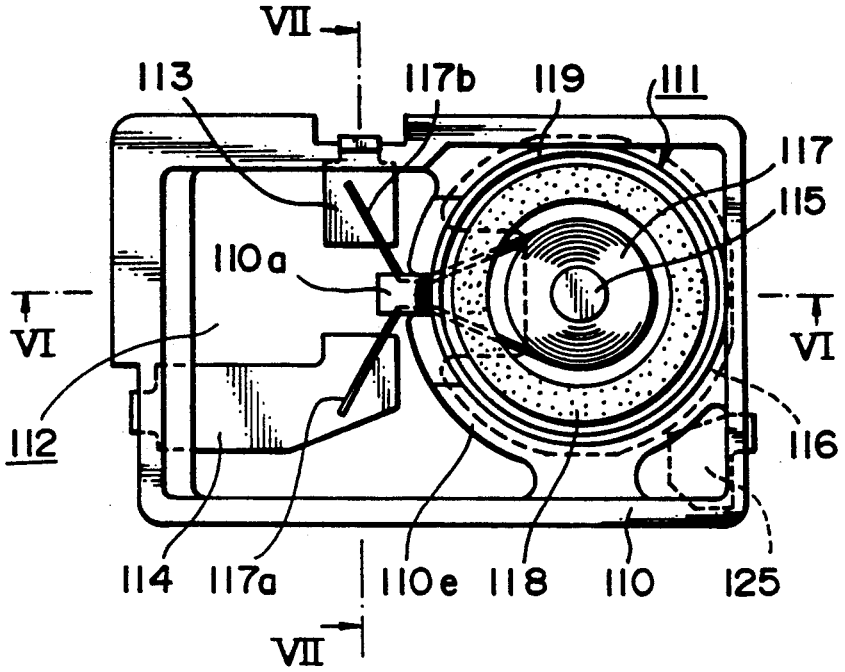
FIG. 5 is a plan view of a second embodiment of a thin buzzer according to the present invention with the lid and the diaphragm removed therefrom.
Figure 6:
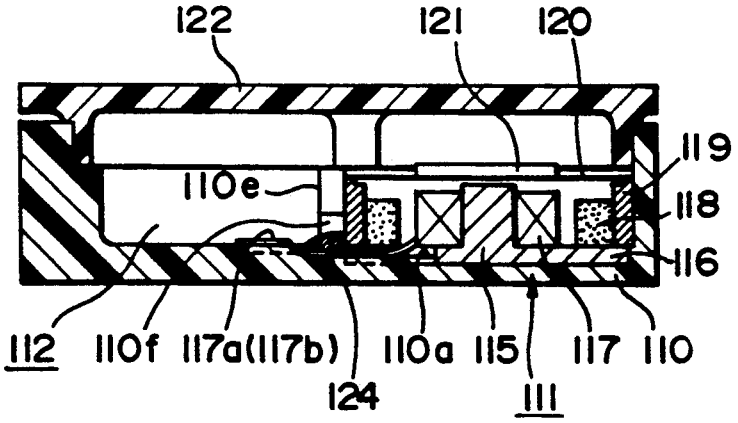
FIG. 6 is a sectional view of the second embodiment shown in FIG. 5 with the lid and diaphragm attached thereto, taken along the line VI—VI.
Figure 7:
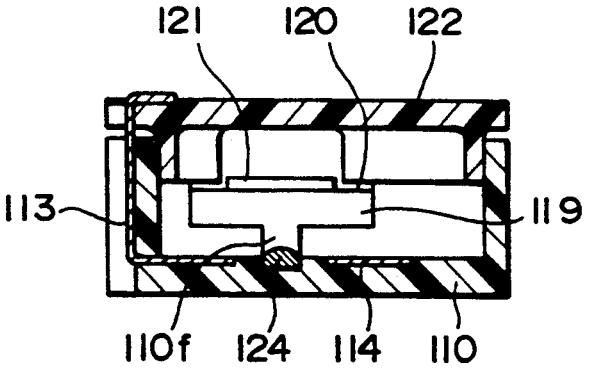
FIG. 7 is a sectional view of the second embodiment shown in FIG. 5 with the lid and diaphragm attached thereto, taken along the line VII—VII.

FIGS. 5 to 7 show a second embodiment of the present invention. Since this embodiment resembles the first embodiment, the elements corresponding to those in the first embodiment are indicated by the same numerals prefixed by the numeral 1 and detailed explanation thereof will be omitted.

In the second embodiment, a diaphragm supporting frame 119 of a buzzer assembly 111 is composed of an annular member which is provided separately from a buzzer case 110. After an exciting coil 117 is incorporated into the diaphragm supporting frame 119, the diaphragm supporting frame 119 is incorporated into the buzzer case together with a magnet 118. As is clear from FIG. 6, in the second embodiment, an iron core 115 and a yoke base 116 are integrally molded.

In order to position the supporting frame 119, the buzzer case 110 is provided with a buzzer assembly supporting portion 110*e*, and a notched groove 110*f* for guiding a terminal 117*a* (117*b*) of the exciting coil 117 therethrough is provided on the supporting portion 110*e*.

After the exciting coil 117 is fixed on the iron core 115 by an adhesive, the exciting coil terminals 117*a*, 117*b* are guided to a lead connecting chamber 112 through the notched groove 110*f* provided on the buzzer case 110 and are safely and easily connected to terminals 113, 114 for external connection. The diaphragm supporting frame 119, the magnet 118 and a diaphragm 120 are then disposed in the buzzer case 110, and a lead groove 110*a* is sealed by a sealing adhesive 124, thereby securing a resonance space for the buzzer assembly 111. It goes without saying that it is also preferable in this embodiment that the exciting coil terminals 117*a*, 117*b* are first led into the lead connecting buzzer case 110, and after the buzzer assembly 111 is completed by attaching the diaphragm supporting frame 119, the magnet 118 and the diaphragm 120 to the buzzer case 110 in this state, the exciting coil terminals 117*a*, 117*b* are connected to the terminals 113, 114 for external connection.

After the connection of the exciting coil terminals is completed, the lead groove 110*a* may be sealed by the adhesive 124 so as to secure the resonance space for the buzzer assembly 111.

In the second embodiment, the terminals 113, 114 for external connection are extended toward a lid 122 and connected to a printed circuit board on the lid 122. The reference numeral 125 represents a dummy terminal which serves as a reinforcing terminal when mounting the thin buzzer on the printed circuit board like the dummy terminal 25 in the first embodiment.

Figure 8:
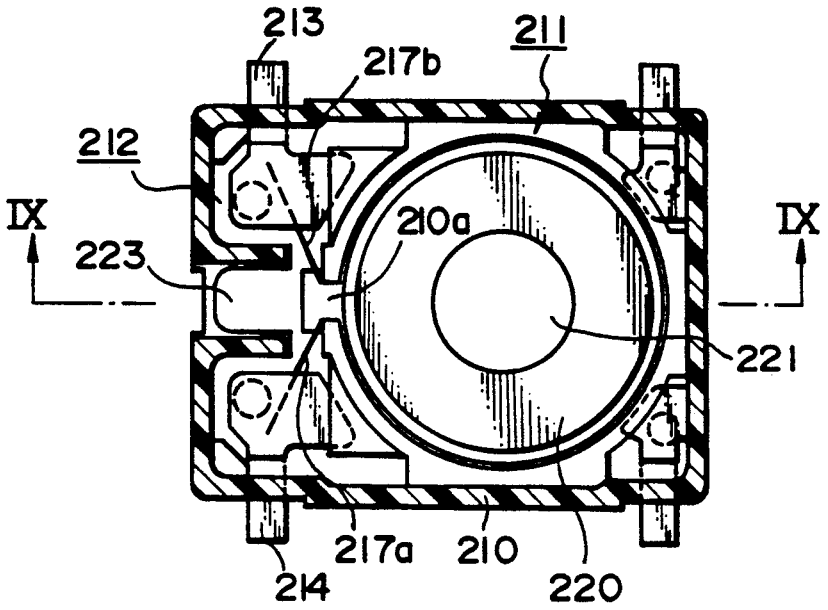
FIG. 8 is a plan view of a third embodiment of a thin buzzer according to the present invention.
Figure 9:
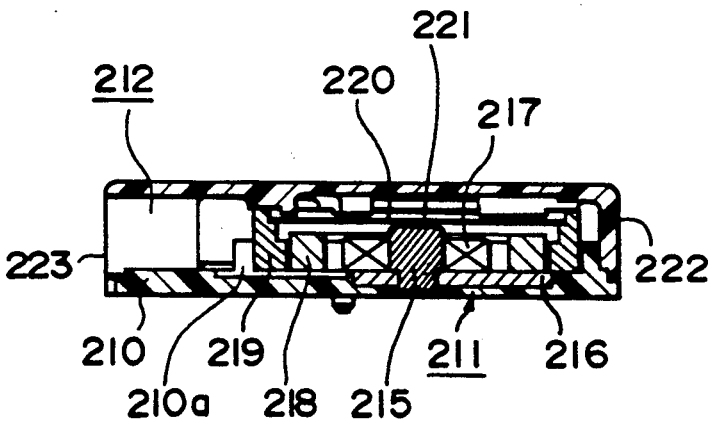
FIG. 9 is a sectional view of the third embodiment shown in FIG. 8, taken along the line IX—IX.

FIGS. 8 and 9 show a third embodiment of the present invention. Since this embodiment resembles the first embodiment, the elements corresponding to those in the first embodiment are indicated by the same numerals prefixed by the numeral 2 and detailed explanation thereof will be omitted.

In the third embodiment a buzzer case 210 is composed of a substantially flat plate unlike the box-shaped buzzer cases in the first and second embodiments. A lid 222 is shaped like a box. As a result, the third embodiment is advantageous because of the good workability at the time of soldering the terminals 217*a*, 217*b* of an exciting coil 217 to terminals 213, 214 for external connection. That is, since the buzzer case 210 is substantially flat and has no side wall, elaborate work such as winding the coil ends and soldering the coil terminals 217, 271*b* is easy.

As is clear from FIGS. 8 and 9, an opening 223 is narrower than those in the first and second embodiments due to the shape of the lid 222. The third embodiment is also advantageous in that the volume and the frequency characteristic of sound are controlled as desired by regulating the shape of the opening 223.

Although the magnet and the diaphragm supporting frame have separate structures in the above embodiments, these may be integrally provided, and the diaphragm may be supported by a part of the magnet.

In the above embodiments, the terminals for external connection also have a function of mounting the buzzer to a printed circuit board by soldering, but these terminals may be terminal pins protruding downward from the buzzer case so as to be inserted into terminal holes on a printed circuit board.

According to the present invention, the buzzer assembly may be either a closed type or an open type. If the opening for the coil terminals which are lead to the lead connecting chamber therethrough is not sealed by an adhesive or the like and used as the opening as it is, the buzzer assembly having a sounding opening is obtained. In such an open type buzzer assembly, the sound frequency characteristic may have a comparatively wideband characteristic. If an exciting current applied to the exciting coil is an alternating current so that the sound frequency has a large bandwidth, and the sound quality of the buzzer is varied or the buzzer is provided with a structure for a speaker, it is possible to provide a thin buzzer which is capable of reproducing voice signals.

As explained above, according to the present invention, it is possible to provide a smaller and thinner buzzer, and it is also possible to facilitate the operation of connecting the exciting coil terminals and the terminals for external connection by introducing the exciting coil terminals into a wide space outside the buzzer assembly within the buzzer case. In conventional buzzers, the coil terminal portions guided through an opening portion are soldered to the terminals for external connection and the opening portion is thereafter sealed by a sealing adhesive. In this case, the solder or the sealing adhesive sometimes protrudes out of the buzzer case. In contrast, according to the present invention, since the solder or the like is prevented from protruding to the outside of the buzzer case and exerting any deleterious influence on the dimensional accuracy of the external shape of the buzzer case, it is possible to maintain the automatic assembly accuracy and to lessen the probability of soldering defects. It is also possible to provide a thin buzzer which has mass productivity and a stable quality.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A thin buzzer comprising:

a buzzer case which incorporates a buzzer assembly including an exciting coil and a lead connecting chamber provided adjacent to the buzzer assembly, the lead connecting chamber being aligned with and opened to the buzzer assembly;

terminals for external connection each of which is integrally connected to the buzzer case with one end externally exposed and the other end extended to the lead connecting chamber;

the terminals of the exciting coil being connected to the terminals for external connection in the lead connecting chamber within the buzzer case, whereby said lead connecting chamber provides a resonance space for improving acoustic efficiency of said buzzer.

2. A thin buzzer comprising:

a buzzer case which incorporates a buzzer assembly and a lead connecting chamber provided adjacent to the buzzer assembly, the lead connecting chamber being aligned with and opened to the buzzer assembly;

terminals for external connections, each of the terminals being integrally connected to the buzzer case with one end externally exposed so as to mount the buzzer on a printed circuit board and the other end extended to the lead connecting chamber;

the buzzer assembly including an exciting coil which is fixed to the buzzer case, a magnet disposed around the exciting coil, a diaphragm supporting frame disposed around the magnet and a diaphragm with the periphery thereof supported by the diaphragm supporting frame;

the buzzer case, the diaphragm supporting frame and the diaphragm together forming a closed resonance space;

the buzzer case being provided on the inner surface thereof with a lead groove for guiding the exciting coil terminals therethrough; and the exciting coil terminals being connected to the terminals for mounting the buzzer on the printed circuit board in the lead connecting chamber within the buzzer case.

3. A thin buzzer comprising:

a buzzer case which incorporates a buzzer assembly and a lead connecting chamber provided adjacently to the buzzer assembly, the lead connecting chamber being aligned with and opened to the buzzer assembly;

terminals for external connections, each of the terminals being integrally connected to the buzzer case with one end externally exposed so as to mount the buzzer on a printed circuit board and the other end extended to the lead connecting chamber;

the buzzer assembly including an exciting coil which is fixed to the buzzer case, a magnet disposed around the exciting coil, a diaphragm supporting frame disposed around the magnet and a diaphragm with the periphery thereof supported by the diaphragm supporting frame;

the buzzer case, the diaphragm supporting frame and the diaphragm together forming a closed resonance space;

the buzzer case being provided on the inner surface thereof with a lead groove for guiding the exciting coil terminals therethrough;

the exciting coil terminals being connected to the terminals for mounting the buzzer on the printed circuit board in the lead connecting chamber within the buzzer case; and the lead groove being sealed after the connection of the exciting coil terminals.

4. A thin buzzer comprising:

a buzzer case which incorporates a buzzer assembly and a lead connecting chamber provided adjacently to the buzzer assembly, the lead connecting chamber being aligned with and opened to the buzzer assembly;

terminals for external connections, each of the terminals being integrally connected to the buzzer case with one end externally exposed so as to mount the buzzer on a printed circuit board and the other end extended to the lead connecting chamber;

the buzzer assembly including an exciting coil which is fixed to the buzzer case, a magnet disposed around the exciting coil, a diaphragm supporting frame disposed around the magnet and a diaphragm with the periphery thereof supported by the diaphragm supporting frame;

the buzzer case, the diaphragm supporting frame and the diaphragm together forming a closed resonance space;

the buzzer case being provided on an inner surface thereof with a lead groove for guiding the exciting coil terminals therethrough;

the exciting coil terminals being connected to the terminals for external connections in the lead connecting chamber within the buzzer case; and the lead connecting chamber forming a second resonance space.

5. A buzzer according to any of claims 2 to 4, wherein the diaphragm supporting frame of the buzzer assembly is composed of an annular member which is provided separately from the buzzer case.

6. A buzzer according to any of claims 1 to 4, wherein the buzzer case is shaped like a flat plate and a box-shaped lid is attached thereto.

* * * * *